US007044226B2

(12) United States Patent
Stave

(10) Patent No.: US 7,044,226 B2
(45) Date of Patent: May 16, 2006

(54) METHOD AND A DEVICE FOR REMOVING A HYDRATE PLUG

(75) Inventor: Roger Stave, Knarrevik (NO)

(73) Assignee: AGR Subsea AS, Straume (NO)

( * ) Notice: Subject to any disclaimer, the term of this patent is extended or adjusted under 35 U.S.C. 154(b) by 0 days.

(21) Appl. No.: 10/513,681

(22) PCT Filed: May 6, 2003

(86) PCT No.: PCT/NO03/00147

§ 371 (c)(1),
(2), (4) Date: Jan. 3, 2005

(87) PCT Pub. No.: WO03/095792

PCT Pub. Date: Nov. 20, 2003

(65) Prior Publication Data

US 2005/0217855 A1 Oct. 6, 2005

(30) Foreign Application Priority Data

May 7, 2002 (NO) ..... 20022166

(51) Int. Cl.
*E21B 37/00* (2006.01)
*E21B 23/08* (2006.01)

(52) U.S. Cl. ..... 166/312; 166/155; 166/222; 166/242.3; 15/104.061; 134/22.12; 134/24

(58) Field of Classification Search ..... 166/312, 166/383, 222, 117.7, 242.2, 242.3, 384, 155; 15/104.061, 104.062; 134/22.12, 24
See application file for complete search history.

(56) References Cited

U.S. PATENT DOCUMENTS

| | | | | |
|---|---|---|---|---|
| 3,020,958 | A * | 2/1962 | Kenneday | 166/118 |
| 3,346,045 | A | 10/1967 | Knapp et al. | |
| 3,525,401 | A * | 8/1970 | Childers et al. | 166/383 |
| 4,027,730 | A * | 6/1977 | Sparlin | 166/156 |
| 4,124,039 | A | 11/1978 | St. Laurent | |
| 4,909,325 | A * | 3/1990 | Hopmann | 166/312 |
| 4,986,311 | A | 1/1991 | Mikkelson | |
| 5,209,304 | A * | 5/1993 | Nice | 166/383 |
| 5,402,850 | A * | 4/1995 | Lalande et al. | 166/301 |
| 6,315,498 | B1 * | 11/2001 | Baugh et al. | 405/184 |
| 6,343,652 | B1 | 2/2002 | Corre et al. | |
| 6,374,838 | B1 * | 4/2002 | Baugh | 134/167 C |
| 6,651,744 | B1 * | 11/2003 | Crawford | 166/311 |

FOREIGN PATENT DOCUMENTS

| | | |
|---|---|---|
| CH | 671 422 A5 | 8/1989 |
| EP | 0 457 375 A1 | 11/1991 |
| NO | 180783 | 6/1997 |
| WO | WO 99/27223 A2 | 6/1999 |
| WO | WO 01/34940 A2 | 5/2001 |

* cited by examiner

*Primary Examiner*—Hoang Dang
(74) *Attorney, Agent, or Firm*—Foley & Lardner LLP

(57) ABSTRACT

A method and a device for removing a hydrate plug (38) from a pipeline (16), wherein a pig (1), which is connected to an umbilical (2) extending to surface, is displaced down into the pipeline (16) until proximity of the hydrate plug (38), after which a fluid arranged with hydrate-plug-dissolving properties is pumped through the umbilical (2).

20 Claims, 4 Drawing Sheets

METHOD AND A DEVICE FOR REMOVING A HYDRATE PLUG

This invention concerns a method for removing a hydrate plug, especially for use in connection with so-called multiphase flow relating to petroleum recovery. The invention also comprises a device for practising the method.

So-called multiphase flow, in which hydrocarbons, water and gas flow together in a common pipeline, is gaining increased use in petroleum recovery. Hydrate plugs (ice plugs) are known to form during such flows, and the plugs block through-flow in the pipeline. So-called hydration commonly appears at high pressures and low temperatures. A hydrate plug is particularly prone to form during an unintended shutdown, in which case the flow is disrupted and the fluid in the pipeline has time to cool down more than usual during common production.

When using a floating production and storage vessel, a so-called Floating Production, Storage and Offloading (FPSO) vessel, hereinafter termed "the vessel", often relating to petroleum recovery at large sea depths, hydrate plug formations have caused unfortunate operational interruptions.

It is known to provide the pipeline with thermal insulation to counteract hydrate plug formation.

In the pipeline, a hydrate plug normally may not be removed by means of differential pressure acting against the two end surfaces of the hydrate plug. When using such a method, this is due to the risk of equipment and personnel being imperilled when the hydrate plug breaks loose and then is moved at great speed within the pipeline. Thus, it is necessary to maintain a substantially equal pressure at both sides of the hydrate plug while dissolving it by means of heating or chemicals.

It is obvious that it may be difficult to reach the hydrate plug with, for example, chemicals when the hydrate plug blocks the pipeline.

The object of the invention is to remedy the disadvantages of the prior art.

The objective is achieved in accordance with the invention disclosed in the following specification and in the subsequent patent claims.

The free end portion of a pipe, generally in the form of an umbilical being provided with several separate conduits and cables, is connected to a pig. In a sealing manner, the umbilical extends axially through the pig, and the conduits of the umbilical terminate within the pipeline at the pig end portion facing the hydrate plug.

In a preferred embodiment, the pig comprises a somewhat lengthy and flexible body that is shaped in a manner allowing it to be displaced through a pipe bend having a relatively small bending radius.

When a hydrate plug is to be removed from the pipeline, the pig is sluiced into the pipeline in a manner per se. Via a stuffing box, the umbilical is pulled into the pipeline from an umbilical reel.

The pig is pumped into the pipeline while the fluid that is located between the hydrate plug and the pig, is drained via the umbilical conduit into a collection tank placed on the vessel.

After the pig is displaced onto the hydrate plug, a fluid arranged with hydrate-plug-dissolving properties, for example a warm fluid and/or chemicals, is circulated down through one umbilical conduit while fluid flows back through at least one other umbilical conduit until the hydrate plug is removed. While this process is ongoing, the tool simultaneously may move forward as the hydrate plug is dissolved. The pig may then be pumped back, for example by pumping fluid in through the umbilical, or it may be pulled out of the pipeline, for example by means of the tractor feeder and/or the umbilical reel.

When displacing the pig out of the pipeline, it may be advantageous to supply chemicals, for example methanol or glycol, to prevent new hydrate plugs from forming, or possibly gas to gradually reduce the static pressure of the liquid column as the plug returns to surface.

The method makes possible to dissolve hydrate plugs in pressurized pipelines. The pressure in the pipeline may be controlled and adjusted in a manner allowing the pressure-temperature relation to be maintained in a mutual relation that reduces the risk of hydrate plug formation. A potential liquid column located within the riser from the seabed onto the vessel may be removed when displacing the hydrate plug out of the pipeline.

In the following a non-restrictive example of a preferred method and device is described, these being illustrated in the accompanying drawings, in which.

Figure 3:
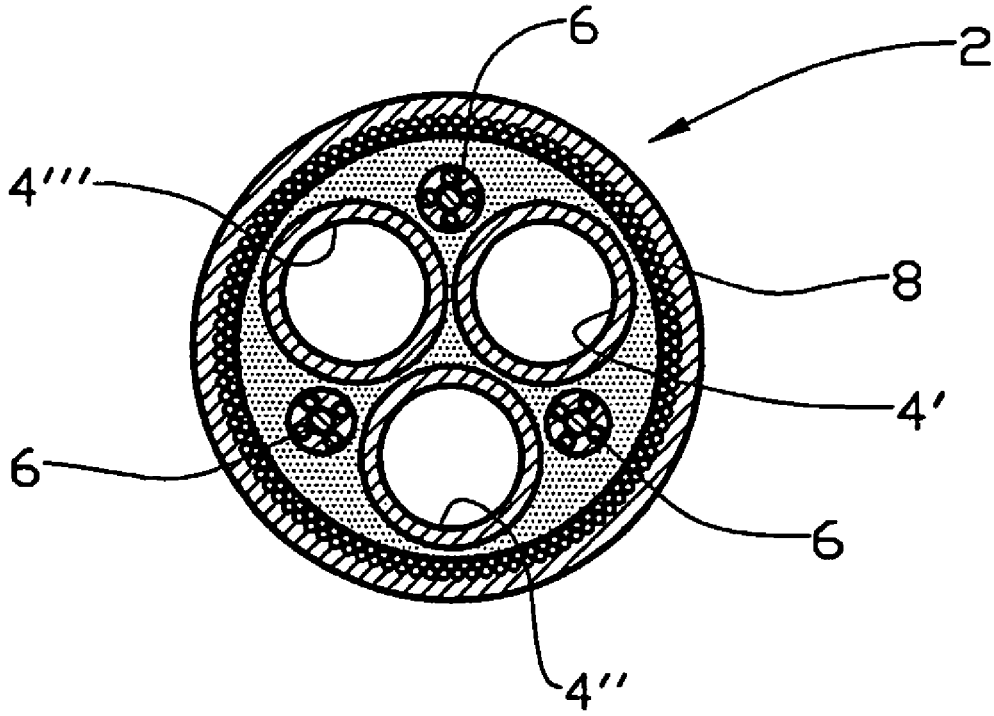
FIG. 3 depicts a radial section of the umbilical.

In the drawings, reference numeral 1 denotes a pig connected to an umbilical 2. The umbilical 2 is provided with three conduits 4', 4" and 4'", a number of cables 6 and a reinforced mantle 8, cf. FIG. 3.

Figure 2:
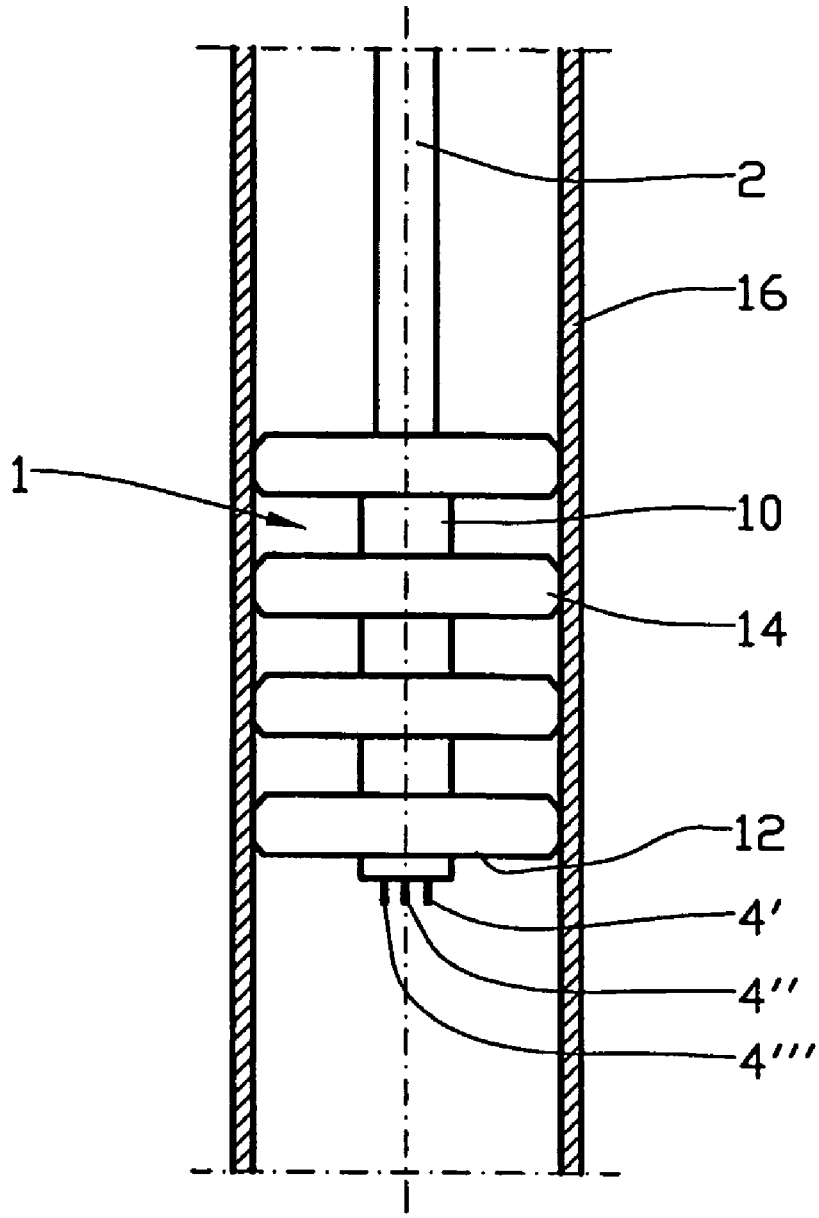
FIG. 2 depicts, in larger scale, a principle drawing of the pig.

While sealing against the exterior, the umbilical 2 extends through the relatively flexible body 10 of the pig 1 and terminates at the front-end portion 12 of the pig 1, cf. FIG. 2. The pig 1 is provided with seals 14 arranged to seal against the inner pipe wall of a pipeline 16.

The umbilical 2 extends through a stuffing box 18 onto a umbilical reel 22, where the conduits 4', 4", 4'" of the umbilical 2 may be connected to a chemical tank 24 and/or a collection tank 26 via pipes 28 and 30, respectively, and via valves and pumps (not shown) in a manner per se.

Fluid for displacing the pig 1 into the pipeline 16 is pumped into the pipeline 16 from a tank 32 via a pump 34 and a valve 36.

Figure 1:
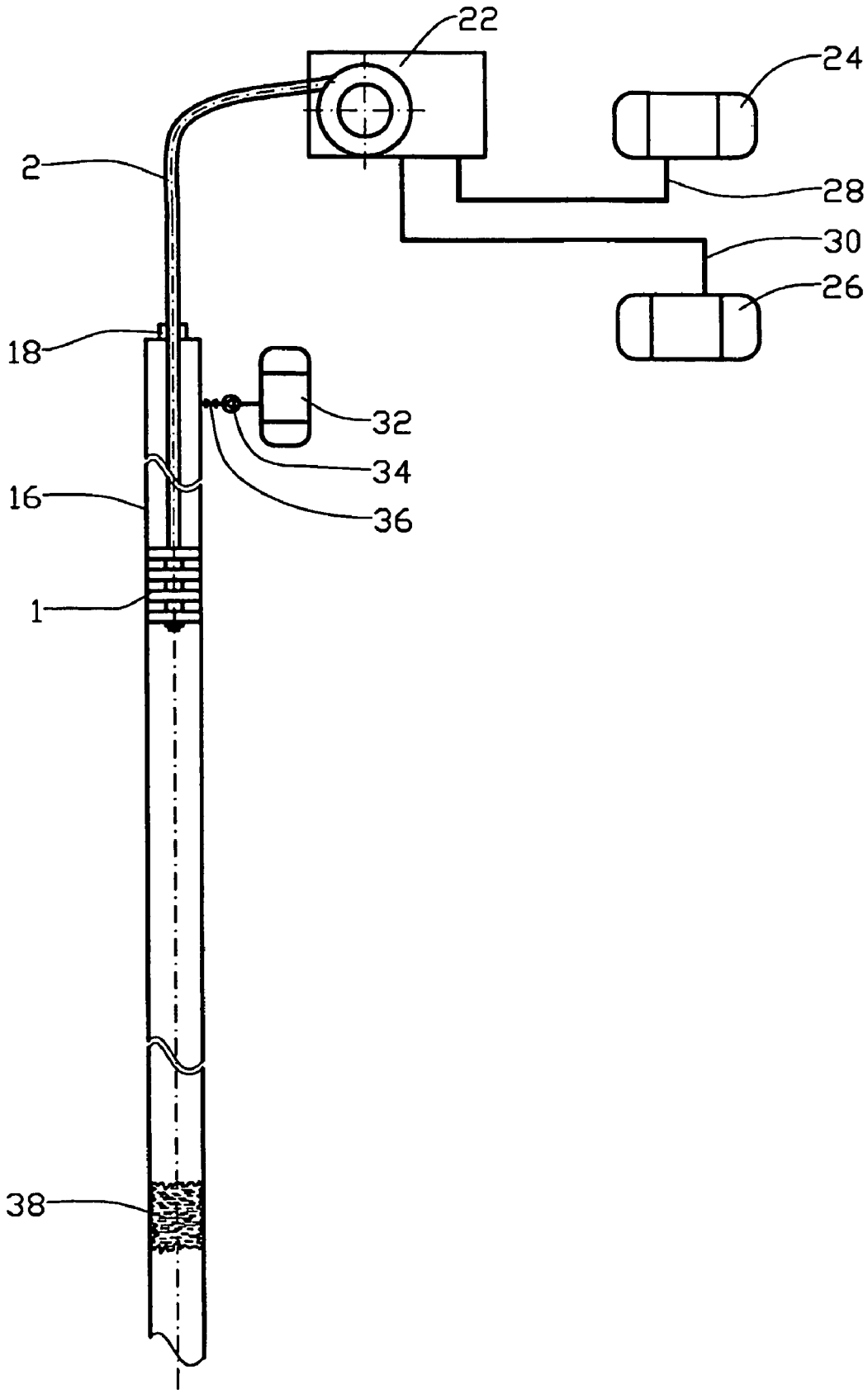
FIG. 1 depicts schematically a pig provided to an umbilical when displacing the pig in a pipeline blocked by a hydrate plug.

When a hydrate plug 38 is to be removed, the pig 1 is sluiced in a manner per se into the pipeline 16 while the umbilical is placed in the stuffing box 18. Fluid from the tank 32 is pumped, via the pump 34 and the valve 36, into the pipeline 16 where the fluid drives the pig 1 inwards in the pipeline 16, while the fluid located in the pipeline 16 between the pig 1 and the hydrate plug 38 is drained into the collection tank 26 via one or several conduits 4', 4", 4'" of the umbilical 2 and the pipe 30, cf. FIG. 1. Simultaneous with this ongoing process, chemicals may be injected to prevent hydrates from forming in the conduits of the umbilical.

Figure 4:
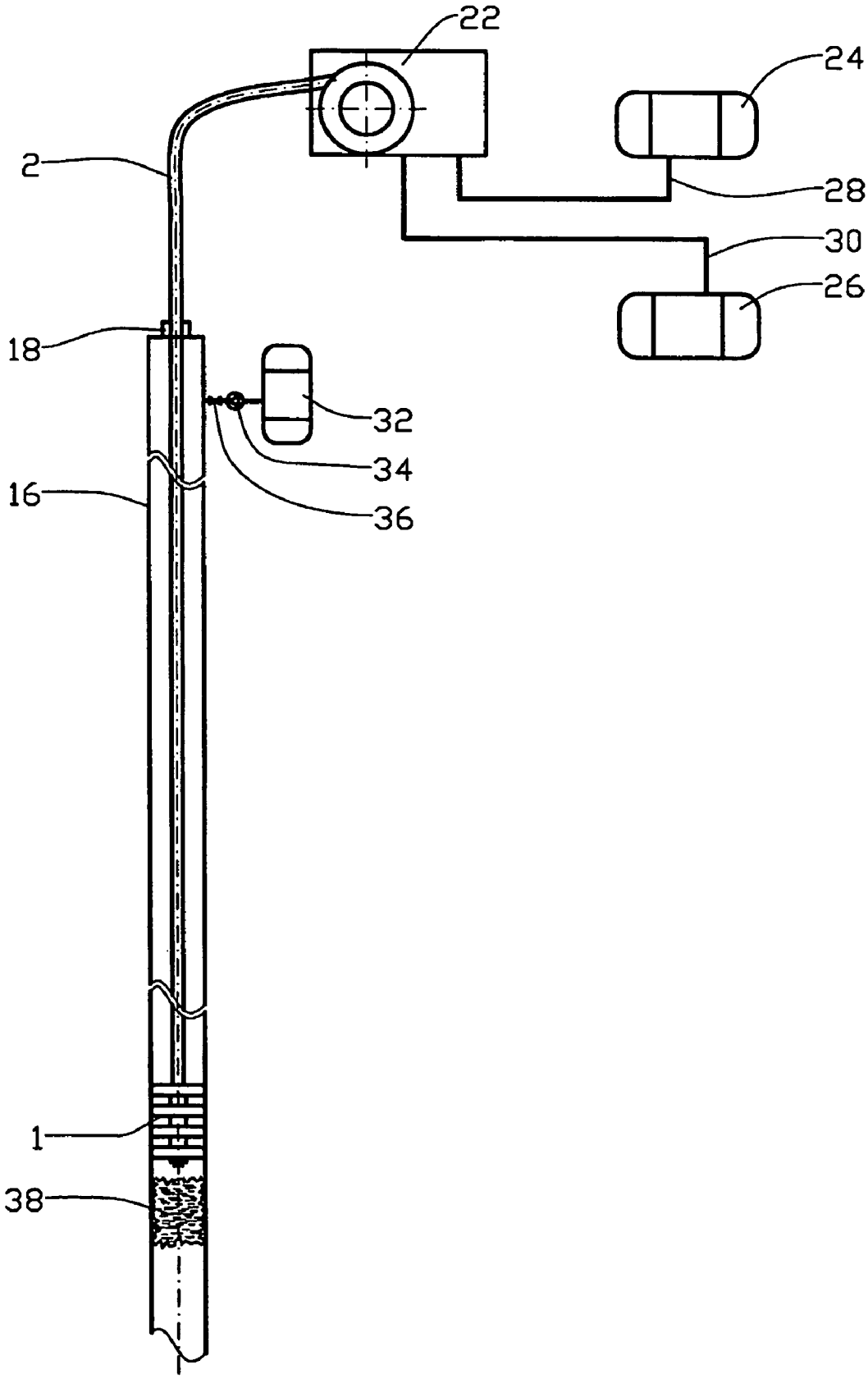
FIG. 4 depicts the same as FIG. 1, but here the pig is displaced onwards to the hydrate plug.

When the pig. 1 is displaced onwards to the region of the hydrate plug 38, cf. FIG. 4, chemicals are pumped from the chemical tank 24, via the pipe 28 and at least one of the conduits 4', 4", 4'", onwards to the front-end portion 12 of the pig 1. Chemicals thus flow from the front-end portion 12 towards the hydrate plug 38, whereby the hydrate plug is dissolved and removed. The excess fluid from the region between the pig 1 and the hydrate plug 38 is drained via at least one of the conduits 4', 4", 4'" and the pipe 30 into the collection tank 26.

Via the umbilical 2, the umbilical reel 22 may be used to pull the pig 1 out of the pipeline 16. The pig 1 may also be pumped out by pumping fluid, or chemicals, in through the conduits 4', 4", 4'''.

The invention claimed is:

1. A method for removing a hydrate plug from a pipeline where a pipe extends to a surface of the Earth, wherein the pipe, having at least two conduits extending at least substantially the length of the pipe, is attached to a pig that is displaced into the pipeline until arriving at a proximity of the hydrate plug, after which a fluid arranged with hydrate-plug-dissolving properties is circulated through the pipe.

2. A method according to claim 1, wherein, while displacing the pig in the pipeline, fluid is drained through the pipe.

3. A method according to claim 1, wherein, while displacing the pig in the pipeline, fluid is supplied with chemicals through the pipe to prevent hydrates from forming in the conduits of the pipe.

4. A method according to claim 1, wherein, while displacing the pig in the pipeline, fluid is supplied through the pipe.

5. A device for removing a hydrate plug from a pipeline where a pipe extends to a surface of the Earth, wherein the pipe is connected to a pig that is displaceable into the pipeline to the proximity of the hydrate plug, and wherein the pipe is provided with at least two conduits extending at least substantially the length of the pipe.

6. A device according to claim 5, wherein the pig is provided with a relatively flexible body.

7. A device according to claim 5, wherein the pipe extends through the pig and is attached at the leading edge of the pig.

8. A device according to claim 6, wherein the pipe extends through the pig and is attached at the leading edge of the pig.

9. A device according to claim 5, wherein the pipe extends through the pig and is terminated at the leading edge of the pig.

10. A device according to claim 6, wherein the pipe extends through the pig and is terminated at the leading edge of the pig.

11. A method for removing a hydrate plug from a pipeline comprising:

moving a pig and at least two fluid conduits, separate from the pipeline and connected to the pig, through the pipeline from a first location proximate to a surface of the Earth to a location proximate the hydrate plug such that the at least two conduits extend at least substantially the distance between the pig and the first location when the pig is at the location proximate the hydrate plug; and circulating a hydrate-plug-dissolving fluid through the at least two fluid conduits to dissolve at least a portion of the hydrate plug.

12. The method of claim 11, wherein at least a substantial length of the conduits are located in a pipe, the pipe extending at least substantially the distance between the pig and the first location proximate to a surface of the Earth when the pig is at the location proximate the hydrate plug.

13. The method of claim 11, wherein movement of the pig is accomplished by establishing a differential pressure on either side of the pig, with respect to the direction of movement of the pig within the pipeline, and wherein the differential pressure on either side of the pig is entirely established by adjusting valving located at at least one of the first location and a second location proximate to a surface of the Earth.

14. The method of claim 11, wherein circulation of the fluid through the at least two conduits is entirely established by adjusting valving located at at least one of the first location and a second location proximate to a surface of the Earth.

15. The method of claim 13, wherein circulation of the fluid through the at least two conduits is entirely established by adjusting valving located at at least one of the first location and a second location proximate to a surface of the Earth.

16. The method of claim 11, further comprising, to move the pig to the location proximate to the hydrate plug, pumping a displacement fluid into the pipeline to create a higher pressure on one side of the pig, with respect to the direction of movement of the pig within the pipeline, and enabling effective movement of trapped fluid located between the pig and the hydrate plug through at least one of the at least two conduits.

17. The method of claim 16, wherein the trapped fluid located between the pig and the hydrate plug is moved to at least one of the first location and a second location proximate to a surface of the Earth.

18. The method of claim 16, further comprising, to move the pig away from the location proximate to the hydrate plug, enabling effective movement of fluid from one side of the pig, with respect to the direction of movement of the pig within the pipeline, to another side of the pig, wherein (i) enabling effective movement of fluid from one side of the pig to another side of the pig and (ii) enabling movement of trapped fluid located between the pig and the hydrate plug through at least one of the at least two conduits is performed entirely by adjusting valving located at at least one of the first location proximate to a surface of the Earth and a second location proximate to a surface of the Earth.

19. The method of claim 11, wherein the actions detailed in claim 11 are accomplished without utilizing moving components on the pig.

20. A pig assembly adapted to remove a hydrate plug from a pipeline, comprising:

a pig; and at least two fluid conduits connected to the pig, the at least two fluid conduits being of sufficient length to extend at least substantially the distance between the pig and a first location proximate to a surface of the Earth when the pig is proximate the hydrate plug; wherein the pig assembly is adapted to circulate a fluid with hydrate-plug-dissolving properties through the at least two fluid conduits, the circulation being performed without valves on the pig.

* * * * *